US007108264B2

(12) United States Patent
Byme et al.

(10) Patent No.: US 7,108,264 B2
(45) Date of Patent: Sep. 19, 2006

(54) METHOD OF PLAYING BLACKJACK

(75) Inventors: Michael Byme, Scottsdale, AZ (US); Carl Emler, Avondale, AZ (US)

(73) Assignee: Ft. McDowell Mohave Apache Indian Community, Fountain Hills, AZ (US)

( * ) Notice: Subject to any disclaimer, the term of this patent is extended or adjusted under 35 U.S.C. 154(b) by 0 days.

(21) Appl. No.: 10/861,961

(22) Filed: Jun. 3, 2004

(65) Prior Publication Data

US 2005/0269780 A1 Dec. 8, 2005

(51) Int. Cl.
*A63F 1/00* (2006.01)

(52) U.S. Cl. ..... 273/292; 273/274

(58) Field of Classification Search ..... 273/292, 273/274, 309; 463/12, 13
See application file for complete search history.

(56) References Cited

U.S. PATENT DOCUMENTS 5,288,077 A * 2/1994 Jones ..... 273/292
6,000,699 A * 12/1999 Long ..... 273/292

* cited by examiner

*Primary Examiner*—Benjamin Layno
(74) *Attorney, Agent, or Firm*—Ellis & Venable P.C.

(57) ABSTRACT

The present invention relates generally to card games and specifically, card games played for monetary gain in casinos. The game is an improvement over the traditional method of playing Blackjack or "21" in that it adds an incentive for a player to make a supplemental wager that also effects the betting strategy of the player. The supplemental wager will pay bonus money based on the value of the cards received from the dealer at the conclusion of the game.

6 Claims, 4 Drawing Sheets

Figure 2

| Rank | Hands by Rank | Odds |
|---|---|---|
| | | |
| 1 | 2, 3, 4, 5, 7 Suited in order | 92,032,559 to 1 |
| 2 | 2, 3, 4, 5 Suited in order | 1,792,959 to 1 |
| 3 | 2, 3, 4, 5, 7 Suited in any order | 873,129 to 1 |
| 4 | 2, 3, 4, 5, 7 Unsuited in order | 359,710 to 1 |
| 5 | 2, 3, 4 Suited in order | 34,815 to 1 |
| 6 | 2, 3, 4, 5 Unsuited in order | 28,036 to 1 |
| 7 | 2, 3, 4, 5 Suited in any order | 17,010 to 1 |
| 8 | 2, 3, 4, 5, 7 Unsuited in any order | 3,000 to 1 |
| 9 | 2, 3, 4 Unsuited in order | 2,177 to 1 |
| 10 | 2, 3, 4 Suited in any order | 661 to 1 |

FIG. 3

| Name of Hand | Sample Hand | Description |
|---|---|---|
| 2, 3, 4, 5, and 7 suited in order | 2♥, 3♥, 4♥, 5♥, and 7♥ | Player must receive the 2, 3, 4, 5, and 7 in succession and all cards must be of the same suit. |
| 2, 3, 4, and 5 suited in order | 2♥, 3♥, 4♥, and 5♥ | Player must receive the 2, 3, 4, and 5 in succession and all cards must be of the same suit. |
| 2, 3, 4, 5, and 7 suited in any order | 5♥, 3♥, 2♥, 7♥, and 4♥ | Player must receive the 2, 3, 4, 5, and 7 in any order, but all cards must be of the same suit. |
| 2, 3, 4, 5, and 7 unsuited in order | 2♣, 3♣, 4♦, 5♥ and 7♠ | Player must receive the 2, 3, 4, 5, and 7 in succession, but the cards can be of varying suits. |
| 2, 3, and 4 suited in order | 2♥, 3♥, and 4♥ | Player must receive the 2, 3, and 4 in succession and all cards must be of the same suit. |
| 2, 3, 4, and 5 unsuited in order | 2♣, 3♦, 4♥ and 5♠ | Player must receive the 2, 3, 4, and 5 in succession, but the cards can be of varying suits. |
| 2, 3, 4, and 5 suited in any order | 5♥, 3♥, 2♥, and 4♥ | Player must receive the 2, 3, 4, and 5 in any order, but all cards must be of the same suit. |
| 2, 3, 4, 5, and 7 unsuited in any order | 5♥, 3♣ 2♣, 7♦, and 4♠ | Player must receive the 2, 3, 4, 5, and 7 in any order and the cards can be of varying suits. |
| 2, 3, and 4 unsuited in order | 2♦, 3♥ and 4♠ | Player must receive the 2, 3, and 4 in succession, but all cards can be of varying suits. |
| 2, 3, and 4 unsuited in any order | 4♦, 2♥ and 3♠ | Player must receive the 2, 3, and 4 in any order and the cards can be of varying suits. |

METHOD OF PLAYING BLACKJACK

FIELD OF THE INVENTION

The present invention relates generally to card games and specifically, card games played for monetary gain in casinos. The game is an improvement over the traditional method of playing Blackjack or "21" in that it adds an incentive for a player to make a supplemental wager that also effects the betting strategy of the player. The supplemental wager will pay bonus money based on the value of the cards received from the dealer at the conclusion of the game.

BACKGROUND OF THE INVENTION

The rules to the game of Blackjack are well known in the prior art. Typically, there are two methods of playing traditional Blackjack: players compete against each other to obtain the highest hand that will total twenty-one or below, or one or more players compete against a dealer, otherwise known as the "house". In both versions, the game is played with one or more decks of 52 cards wherein each card has an assigned value: face cards are worth ten, numbered cards two through ten are worth their face value, and aces are worth one or eleven at the election of the player. The game begins by each player receiving two cards. In sequence, each player is allowed to "hit" or request additional cards until the player "stays" or declines receiving any additional cards, or the value of the player's hand exceeds twenty-one. In the version that includes the house, each player tries to achieve a hand with a higher value than the house. The house usually must play under certain restrictions that require it to continue hitting until the value of the house's hand reaches a certain threshold value such as 16 or 17 or it exceeds 21.

Under the basic rules of Blackjack, a player's only concern is to beat the other players involved in the game or the house. The players entire strategy is focused on obtaining the best possible combination of cards that total 21, or come as close to 21 as possible. However, in a casino it is desirable to provide additional betting options so that the casino's chances of earning more money increases. One of the additional betting options would be to provide a second wager on the total value of the hand received from the dealer using modified rules of Poker.

In the card game of Poker, various combinations of cards have a certain hierarchal value. For instance, if a player is dealt a five card hand, the following is a list of hands from the most difficult to easiest in terms of the odds in obtaining such hands:

| Name of Hand | Sample Hand | Description |
|---|---|---|
| Royal Flush | A♥, K♥, Q♥, J♥, and 10♥ | Hand must include the A, K, Q, J and 10 and all cards must be of the same suit. |
| Straight Flush | 3♥, 4♥, 5♥, 6♥, and 7♥ | Hand must include five cards in sequential order and must be of the same suit. |
| Four of a Kind | A♥, 10♣, 10♦, 10♥ and 10♠ | Four cards of the same value and any other card |
| Flush | A♥, 4♥, 8♥, K♥, and 7♥ | Any five cards all having the same suit. |
| Straight | J♣, 10♣, 9♦, 8♥and 7♠ | Hand must include five cards in sequential order, can be of any suit. |
| Three of a Kind | A♥, K♥, 10♦, 10♥ and 10♠ | Hand must include three cards of the same value. |

-continued

| Name of Hand | Sample Hand | Description |
|---|---|---|
| Two Pair | A♥, A♣ 10♣, 10♦, and 6♠ | Hand must include two pairs of cards having the same value. |
| One Pair | A♥, A♣ 7♣, 10♦, and 6♠ | Hand must include at least two cards having the same value. |

In Blackjack, a hand must consist of a minimum of two and no more than eleven cards. Therefore, it is possible that during the course of a Blackjack game the cards a player receives can be used not only to make a winning Blackjack hand, but also a winning Poker hand. If the rules of Poker hand valuation are modified to emphasize the lower-numbered cards, a player can simultaneously employ strategy to obtain a winning Blackjack hand and Poker hand. In certain instances, a player may have to choose between taking an additional card that would aid his or her Blackjack hand while destroying the potential for a winning poker hand, and vice versa.

DISCUSSION OF THE PRIOR ART

Casino-based card games that involve the use of a side bet for a certain outcome based upon what cards a player receives is known. For instance, the game of Paigow Poker is played in many Las Vegas casinos. In Paigow Poker, each player may place two wagers: one for betting the outcome of the Paigow Poker game, and the other for the total value of the entire set of cards that a player will receive for the game. In Paigow Poker, each player is dealt seven cards and must make the best high-valued hand with five of the seven cards, while at the same time making the best low-valued hand possible with the remaining two cards in an effort to beat the dealer's best high and low hands. The first wager pertains directly to the player's interaction with the dealer. A player wins on the first wager if the player beats the dealer with a better high and low hand. However, the second wager is a bet on the value of all seven cards received from the dealer. A player wins on the second wager if the player is able to create a winning poker hand (usually no worse than a three-of-a-kind) with his or her seven cards. One disadvantage to this form of betting is that the second wager is made without strategy. In other words, because the player is dealt all seven cards at once, the player has no control over the outcome of the hand received from the dealer. Other casino-based card games play similar games involving side betting or secondary wagering, but none combine the game of Blackjack with an additional wagering option that would require the player to employ additional strategy during the course of the game that ultimately would affect the blackjack strategy. A method of playing Blackjack utilizing this type of wagering and strategy is disclosed by the present invention.

SUMMARY OF THE INVENTION

Broadly, it is an object of the present invention to provide a casino-based card game that combines the strategy of both Blackjack and Poker.

It is a further object of the present invention to allow the player of the card game to place two separate wagers on the card game.

It is a further object of the present invention for the first wager to pertain to the rules of Blackjack, while the second wager pertains to the rules of Poker.

It is a further object of the present invention for the player to receive at least two cards to begin the game.

It is a further object of the present invention for the player to decide how many additional cards, if any, will be dealt to complete the player's hand.

The description of the invention which follows, together with the accompanying drawings should not be construed as limiting the invention to the example shown and described, because those skilled in the art to which this invention appertains will be able to devise other forms thereof within the ambit of the appended claims.

BRIEF DESCRIPTION OF THE DRAWINGS

FIG. 2 is a table of the odds of winning the side wager.

FIG. 3 is a table of hand values used in the preferred embodiment.

DESCRIPTION OF THE PREFERRED EMBODIMENT

Figure 1A:
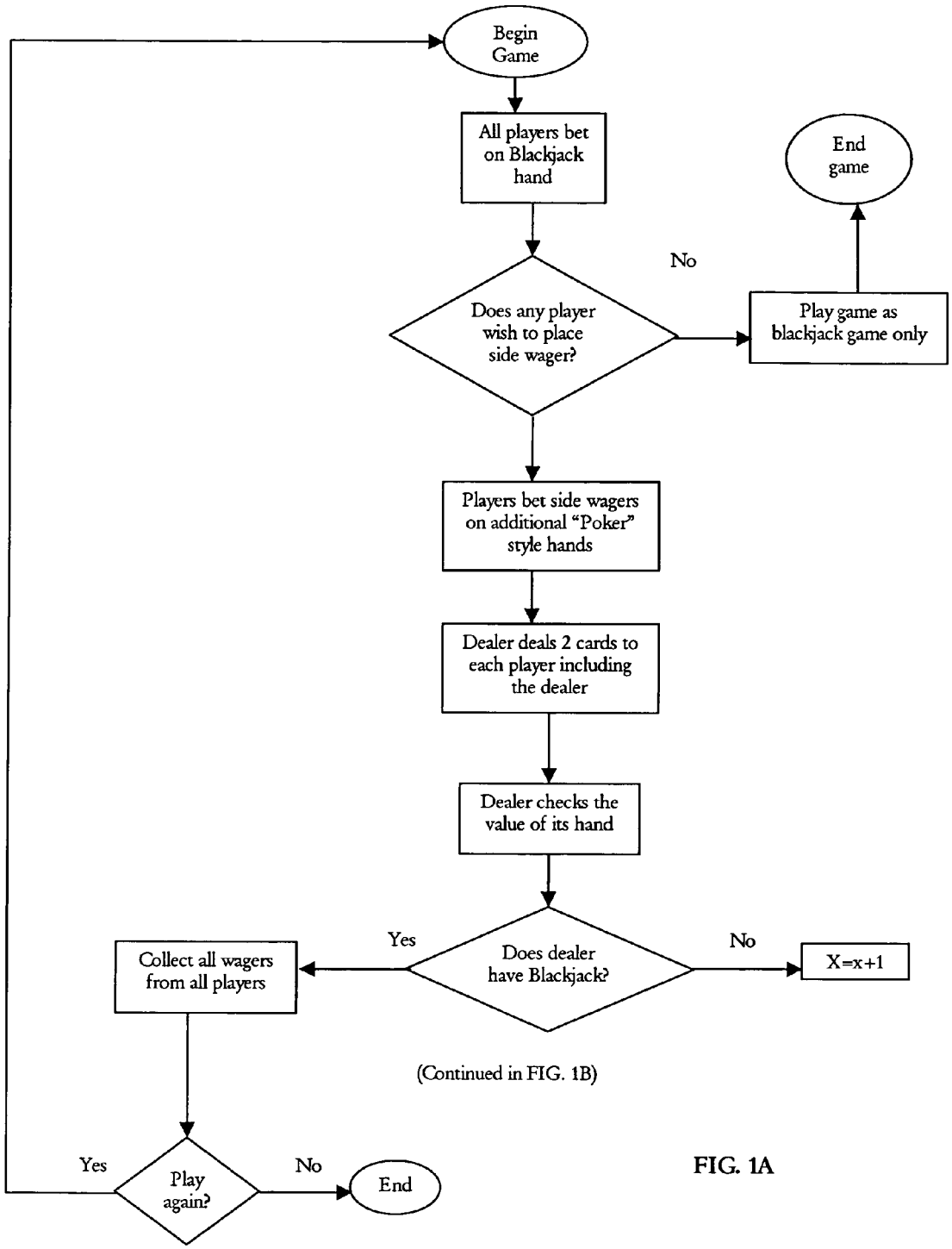
FIGS. 1A and 1B are a single flow chart of the game as it is to be played according to the preferred embodiment.
Figure 1B:
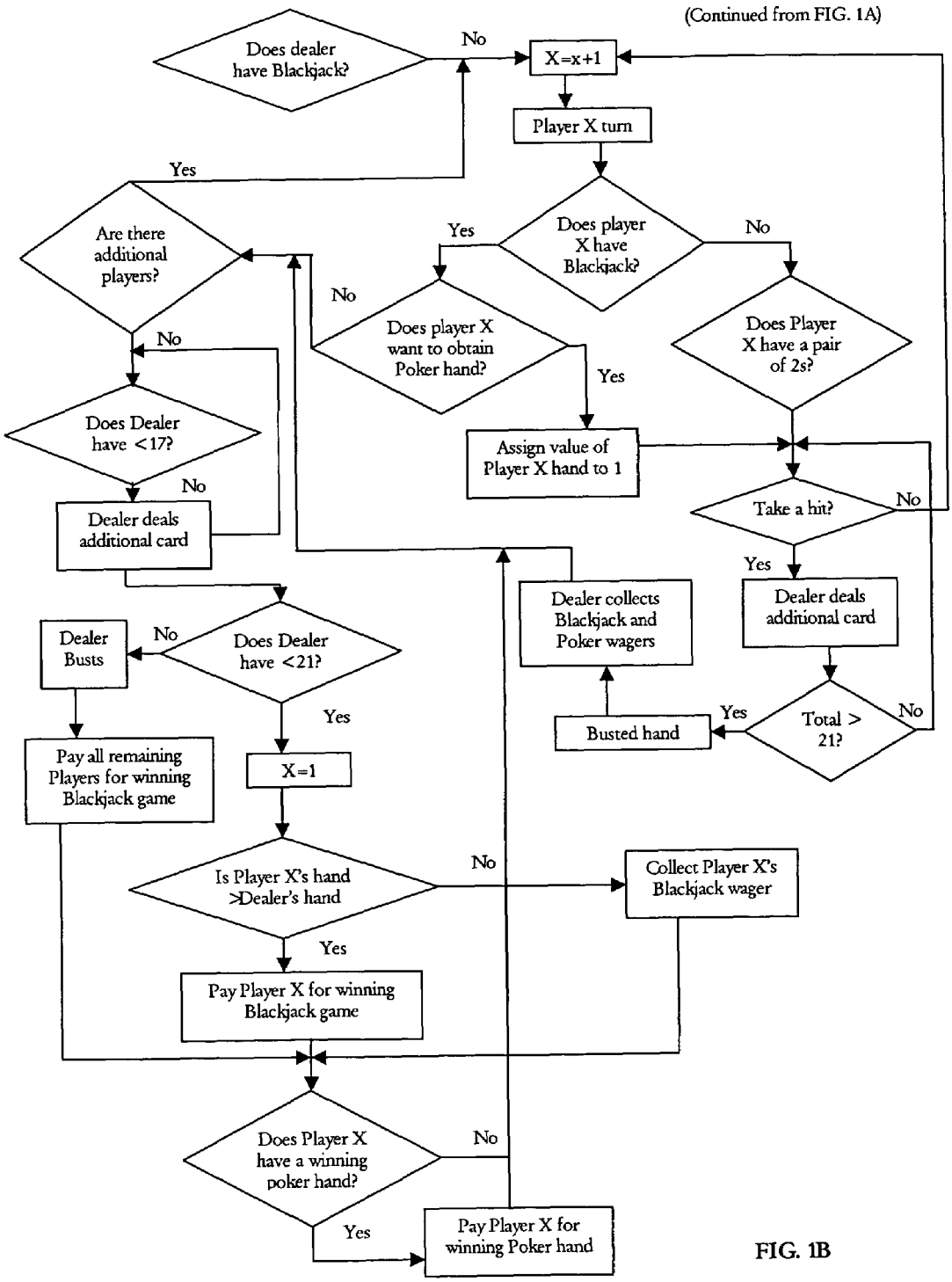

By way of one example of many to serve as background in understanding the present invention, FIGS. 1A and 1B show a flow chart of how the game as set forth in the present invention is to be played. The game begins by having at least one player place a wager on a traditional Blackjack game with the option of placing a second wager on the total value of the player's hand as it is being dealt. In another form of the game, the second wager could be mandatory. For the purpose of this description it will be assumed that the player has chosen to make a second wager. The total value of the hand is determined by the table as shown in FIGS. 2 and 3. The total value of the hand is a function of both the number of cards that may be dealt to a player and the face value of the cards. This will be discussed in more detail below.

The dealer deals each player participating in the game two cards face up and two cards to the dealer; one face up and the other face down. The dealer checks to see if it has Blackjack on the deal. If the dealer has Blackjack, the game is over and all money wagered, including any second wagers, are collected by the dealer. If the dealer has no blackjack, then the game continues.

The player farthest to the dealer's left side checks his or her cards to determine the value of the hand. If the first player has Blackjack then that player is a winner and will collect his or her winnings based on the first wager. If a player has Blackjack, then normally he would forfeit his second wager. However, in an alternative embodiment of the present invention, a player could forego his Blackjack hand and try to obtain a better hand in an effort to win based upon the second wager hand as long as the hand does not exceed 21 in value so that the game continues within the confines of the rules of Blackjack. This is highly unlikely considering that a player with Blackjack has no less than a hand with a value of 11. The dealer will have the option of determining whether an opening deal of Blackjack will terminate the game for a given player or whether the game can continue despite the player receiving a Blackjack.

Assuming that a player does not have Blackjack with the first two cards dealt, the first player must decide whether to "hit" and take additional cards or "stay" and not receive any additional cards from the dealer. Normally in Blackjack, if a player receives two cards with the same face value, the player has the option of "splitting" the identical cards and playing two separate hands. A second hand from a split requires an additional wager on the second hand. If a player receives a pair of 2s from the initial deal and the player decides to split the 2s, the player also has the option of making an optional bonus wager on the total value of the second hand. Again, the dealer would have the option of making the bonus wager on the total value of the second hand mandatory.

If there is no split of the player's hand, the player may request additional cards until the player either obtains a hand that either "busts" by going over 21, receiving a total of 21, or choosing to "stay" on a hand that totals less than 21. If a player has a second hand from a split, the player repeats the process for the second hand. After the player has "busted", obtained 21, or "stayed" on a value of less than 21, the next player in succession repeats the process.

The novel addition to the traditional form of Blackjack described in the present invention requires a player to consider additional strategy as the player receives cards from the dealer. During the initial draw from the dealer, a player may receive a 2 and a 3. Assuming the player decides to receive additional cards, the player only needs to receive a 4 from the dealer to win on the second wager. At that point, the player must decide whether it is worth taking an additional card to try and win the next highest hand value as shown in FIGS. 2 and 3. When a player starts by receiving a 2, 3, and 4, this is normally not a difficult decision to make. However, if a player received a King and 2 on the initial deal, and then received a 3 and 4 for a total of 19, the player must then decide whether to risk receiving a card that will bust the Blackjack hand with the hope of receiving a 5, or losing both the Blackjack and the Poker hand. If the game is played with the option that allows the player to win with a 2, 3, and 4 regardless whether the hand busts on a card other than a 5, the player is more likely to take the risk of taking an additional card to get the 5. However, if the game is played with the option that a bust on a card other than a 5 busts the Blackjack hand and forfeits the opportunity to win based upon the second wager, a player is more likely to take the safe bet and stay on 19. The safe strategy would be to keep -the winnings. However, with the added incentive of possibly winning significantly more money, a player may decide to forego the basic Blackjack strategy and try to obtain a more lucrative poker hand. At the conclusion of the player receiving all cards for a given hand, the dealer moves on to the next player to the dealer's right and repeats the process.

In the version of the game where the dealer does not participate, the dealing of cards concludes. However, in the game where the Dealer participates, when all players have been dealt cards, the dealer deals out its hand under the normal restrictions placed on a dealer, i.e. staying on 16 or 17 and hitting on any value of Blackjack below 16 or 17. Once the dealer's hand reached 17 or greater, or exceeded 21, the game is over and the dealer and player hands can be evaluated to determine if winners exist for both Blackjack and the "Poker" hand obtained during the game. A player is eligible for winning the "Poker" hand only if it has 3 or more cards. At this point, all players who have Blackjack hands whose value exceeds the value of the dealer's hand are paid according to the odds associated with Blackjack. In the case of the players' Poker hands, each player's hand that has 3 or more cards is compared to the table in FIG. 3. If any player has cards that match the cards required under the rules in FIG. 3, the player is paid out according to the odds as shown. After all hands have been evaluated, the game ends and the next hand is dealt.

In other embodiments of the game, the odds of winning on the second wager could significantly be increased by restricting a player from winning on the second wager only if the qualifying cards (2, 3, 4, 5, and 7) are received in any order without interruption from other cards. Under this scenario, the game could be played either by allowing the cards to be received at any time during the deal in sequence or by requiring the player to receive any two of the qualifying cards on the opening deal to make the player eligible to win based upon the second wager. This would also allow the dealer to choose whether a player could continue to take cards even after he or she acquires 21, or preclude a player from hitting so that the value of his or her hand exceeds 21.

While the inventive method of playing Blackjack, as described and claimed herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A method of playing Blackjack comprising the steps of:

a. assigning a dealer the task of dealing at least one deck of cards for a game of Blackjack;

b. assigning core values to each of said at least one deck of cards comprising the following values:

i. numeric cards from two through ten equaling their face value;

ii. face cards equaling ten;

iii. ace cards equaling one or eleven;

c. randomizing said at least one deck of cards;

d. placing of a first wager by a player;

e. placing of a second wager by said player;

f. dealing a first pair of cards from sad at least one deck of cards to said player by said dealer wherein said first pair of cards has a first numeric value based upon said core values assigned to said at least one deck of cards;

g. dealing a second pair of cards from said at least one deck of cards to said dealer by said dealer wherein said second pair of cards has a second numeric value based upon said core values assigned to said at least one deck of cards;

h. computing the second numeric value of said second pair of cards such that if the second numeric value of said second pair of cards equals 21 then, said dealer collects said first and second wagers place by said player;

i. computing the first numeric value of said first pair of cards such that if the first numeric value of said first pair of cards equals 21, then said player has the option of changing the first numeric value to 11 and continue to receive at least one additional card from said at least one deck of cards, said at least one additional card is a player card having a third numerical value;

j. computing the first numeric value such that if the first numeric value equals 21 and said player chose not to change said first numeric value to 11, then said dealer pays said player a first sum of money;

k. having the dealer inquire if the player desires to receive said at least one additional player card from said at least one deck of cards such that if the player answers affirmatively, said dealer deals said at least one additional player card form said at least one deck of cards to the player until said player answers negatively;

l. computing the sum of the first and third numeric values such that the sum is equal to a total player value such that if the total player value is greater than 21, said dealer collects said first and second wagers from said player;

m. computing the second numeric value of said second pair of cards such that if said second numeric value is less than 17, dealing at least one additional card to the dealer, said card being a dealer card wherein said at least one additional dealer card has a fourth numerical value such that the sum of the second numerical value and the fourth numerical value is equal to a total dealer value such that if the total dealer value is greater than 21, then said dealer pays said player a second sum of money based upon said first wager;

n. computing the total dealer value such that if the total dealer value is greater than or equal to 17 and less than or equal to 21, then comparing said total dealer value to the total player value such that if said total player value is greater than said total dealer value, then said dealer pays said player said second sum of money based upon said first wager;

o. computing said total dealer value such that if the total dealer value is greater than or equal to 17 and less than or equal to 21, the comparing said total dealer value to the total player value such that if said total player value is less than said total dealer value, then having said dealer collect said first wager from said player;

p. choosing at least three representations of said cards from said at least one deck of cards such that if said first pair of cards and said at least one additional player cards are identical to said at least three representations of said cards, then having said dealer pay a third sum of money to said player based upon said second wager.

2. The method of claim 1 such that if said first pair of cards is a pair of 2s, said player may split the pair of 2s into a first 2 and a second 2 such that said player places a third wager.

3. The method of claim 1 such that the placing of a second wager by said player is optional.

4. The method of claim 3 further comprising the steps of:

a. choosing at least here representations of cards fomis aid cards of said at least one deck of cards such that if said player receives at least one of said at least three representations of cards ins aid first hand of cards, then if said player does not immediately thereafter receive at least one additional card into said first handoff cards from said at least one deck of cards that is identical to any one of said at least three representations of cards, then said player must pay said dealer said second wager, or;

b. if said player receives at least one of said at least here representations of cards in said second hand of cards then if said player does not immediately thereafter receive at least one additional card into said second hand of cards from said at least one deck of cards that is identical to any one of said at least here representations of cards, then said player must pay said dealer said fourth wager.

5. The method of claims 1 or 3 wherein said at least three representations of cards are chosen from any of a group of cards consisting of a: 2 or 3 or 4 or 5 or 7 of spades; 2 or 3 or 4 or 5 or 7 of clubs; 2 or 3 or 4 or 5 or 7 of hearts; or 2 or 3 or 4 or 5 or 7of diamonds.

6. The method of claim 1 further comprising the steps of:

a. choosing at least thee representations of cards fomis aid cards of said at least one deck of cards such that if said player receives at least one of said at least thee representations of cards, then if said player does not immediately thereafter receive at least one additional card from said at least one deck of cards that is identical to any one of said at least here representations of cards, then said player must pay said dealer said second wager.

* * * * *